US011873834B2

(12) United States Patent
Yang et al.

(10) Patent No.: US 11,873,834 B2
(45) Date of Patent: Jan. 16, 2024

(54) CEILING FAN

(71) Applicant: LG ELECTRONICS INC., Seoul (KR)

(72) Inventors: Seungdeok Yang, Seoul (KR); Jaehyuk Jung, Seoul (KR); Juhyun Kim, Seoul (KR); Seokho Choi, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 18/107,566

(22) Filed: Feb. 9, 2023

(65) Prior Publication Data

US 2023/0250833 A1 Aug. 10, 2023

(30) Foreign Application Priority Data

Feb. 10, 2022 (KR) ..... 10-2022-0017476

(51) Int. Cl.
*F04D 29/38* (2006.01)
*F04D 19/00* (2006.01)
*F04D 29/32* (2006.01)

(52) U.S. Cl.
CPC ..... *F04D 29/384* (2013.01); *F04D 19/002* (2013.01); *F04D 29/325* (2013.01)

(58) Field of Classification Search
CPC ..... F04D 29/384; F04D 25/088
See application file for complete search history.

(56) References Cited

U.S. PATENT DOCUMENTS

| | | | | |
|---|---|---|---|---|
| 6,857,852 | B1 * | 2/2005 | Carfagna | F04D 29/703 416/62 |
| 9,726,192 | B2 * | 8/2017 | Whitley | F04D 29/325 |
| 10,527,046 | B2 * | 1/2020 | Niemiec | F04D 29/384 |
| 11,572,891 | B1 * | 2/2023 | Hsieh | F04D 29/681 |
| 2013/0272879 | A1 * | 10/2013 | Chen | F04D 25/088 416/5 |
| 2015/0300364 | A1 * | 10/2015 | Lin | F04D 29/34 416/221 |
| 2019/0242398 | A1 * | 8/2019 | Tripp | F04D 29/388 |
| 2021/0215163 | A1 * | 7/2021 | Kang | F04D 29/682 |
| 2022/0133941 | A1 * | 5/2022 | Thomsen | F04D 25/088 422/121 |
| 2023/0250833 | A1 * | 8/2023 | Yang | F04D 25/088 416/223 R |
| 2023/0265855 | A1 * | 8/2023 | Yang | F04D 29/384 416/223 R |

FOREIGN PATENT DOCUMENTS

KR 10-2019-0104865 12/2019

* cited by examiner

*Primary Examiner* — Sabbir Hasan
(74) *Attorney, Agent, or Firm* — KED & ASSOCIATES

(57) ABSTRACT

A ceiling fan includes: a column; a hub case which is coupled to the column and rotatable with respect to the column; and a plurality of blades disposed in the hub case, wherein each of the blades includes: an inner blade having one side coupled to the hub case; and an outer blade having one side that is coupled to a part of the other end of the inner blade and disposed farther from an axis of the hub case than the inner blade, wherein the inner blade includes: a first inner blade; and a second inner blade disposed spaced apart from the first inner blade.

19 Claims, 6 Drawing Sheets

CEILING FAN

CROSS-REFERENCE TO RELATED APPLICATION

This application claims the priority benefit of Korean Patent Application No. 10-2022-0017476, filed on Feb. 10, 2022, the disclosure of which is incorporated herein by reference in its entirety.

TECHNICAL FIELD

This disclosure relates to a ceiling fan installed on a ceiling.

BACKGROUND

An apparatus installed on a ceiling to generate air flow is called a ceiling fan.

The ceiling fan consumes less power than an air conditioner or a general electric fan, and since it is installed on the ceiling to flow air toward a floor, it can convect indoor air effectively.

That is, the ceiling fan can forcibly convect air with a relatively large capacity at a ceiling that is located higher than a user.

In general, a ceiling fan includes a driving motor that provides power and a plurality of blades connected to a shaft of the driving motor.

Korean Patent Publication No. 10-2019-0140865 (hereinafter, referred to as prior art) discloses a ceiling fan.

A ceiling fan according to the prior art includes a main blade and a sub blade.

However, since the ceiling fan according to the prior art cuts off a part of the main blade and arranges the sub-blade inside the main blade, there is a problem in that a lifting force generated through rotation of the sub-blade is inevitably limited.

In particular, the air volume is reduced in a blade portion close to a hub, thereby reducing a total air volume.

SUMMARY

The disclosure has been made in view of the above problems, and may provide a ceiling fan capable of increasing air volume by maximizing a lifting force.

The disclosure may further provide a ceiling fan which increases an air volume in a central portion close to a hub, and improves a rigidity of an entire blade.

In accordance with an aspect of the present disclosure, a ceiling fan includes: a column; a hub case which is coupled to the column and rotatable with respect to the column; and a plurality of blades disposed in the hub case, wherein each of the blades includes: an inner blade having one side coupled to the hub case; and an outer blade having one side that is coupled to a part of the other end of the inner blade and disposed farther from an axis of the hub case than the inner blade, wherein the inner blade includes: a first inner blade; and a second inner blade disposed spaced apart from the first inner blade.

The first inner blade is disposed in a position higher than the second inner blade.

The first inner blade and the second inner blade have an overlapping area in which a partial area overlaps in an axial direction of the hub case.

A width of the overlapping area is smaller than a width of the first inner blade and the second inner blade.

A width of the overlapping area is greater than a separation distance between the first inner blade and the second inner blade in the axial direction.

A width of the overlapping area is greater than a thickness of the first inner blade and the second inner blade.

The inner blade further includes a connection arm connecting the first inner blade and the second inner blade.

The first inner blade and the second inner blade have an overlapping area in which a partial area overlaps in an axial direction of the hub case, and wherein the connection arm is located in the overlapping area.

A length of the inner blade is smaller than a length of the outer blade.

A length of the inner blade has a length of 30% to 40% of the length of the blade.

A width of the first inner blade and a width of the second inner blade are smaller than a width of the outer blade.

The width of the first inner blade and the width of the second inner blade are greater than half of the width of the outer blade.

The other end of the first inner blade and one end of the outer blade are connected.

The first inner blade and the outer blade are overlapped in a radial direction orthogonal to the axial direction.

The first inner blade includes: a first inner negative pressure surface defining a surface intersecting the axial direction; and a first inner positive pressure surface which defines a surface intersecting the axial direction and is located below the first inner negative pressure surface, wherein the outer blade includes: an outer negative pressure surface defining a surface intersecting the axial direction; and an outer positive pressure surface which defines a surface intersecting the axial direction and is located below the outer negative pressure surface, wherein the first inner negative pressure surface and the outer negative pressure surface are connected as one surface, and the first inner positive pressure surface and the outer positive pressure surface are connected as one surface.

The first inner blade and the outer blade are formed as one body.

A partial area of the outer blade is located in a position lower than the first inner blade, and other partial area excluding the partial area of the outer blade is located in the same height as the first inner blade.

At least a part of the inner blade has a curvature in which a center of a radius of curvature is located below the inner blade.

At least a part of the outer blade has a curvature in which a center of a radius of curvature is located below the outer blade.

An exit angle of the second inner blade may be the same as an exit angle of the outer blade.

First, since the blade according to an embodiment of the present disclosure constitutes a tandem blade, it can form a larger lifting force than a blade having one positive pressure surface and one negative pressure surface, and through this, can increase the air volume in the same output.

Second, the present disclosure can increase an air volume in a hub portion where the air volume is decreased by using a tandem blade only for a blade close to the hub, and maintain the rigidity of the blade and suppress the twist of the blade, by using a single blade in the outer side where the air volume is sufficient.

Third, in the present disclosure, leading edges of an inner blade and an outer blade are disposed in one straight line, and trailing edges of the inner blade and outer blade are disposed in another straight line, so that the outer blade and the inner blade look like and operate as one blade.

Fourth, the present disclosure has an overlapping area in which two inner blades overlap each other, and the two inner blades are connected by a connection arm, thereby maximizing air volume and further suppressing twisting of two inner blades.

BRIEF DESCRIPTION OF THE DRAWINGS

The above and other objects, features and advantages of the present disclosure will be more apparent from the following detailed description in conjunction with the accompanying drawings, in which.

DETAILED DESCRIPTION

Hereinafter, various embodiments of the present invention will be described with reference to accompanying drawings. However, the embodiment is not limited to specific embodiments, but the embodiment includes all modifications, equivalents, and/or substitutes belonging to the technical scope of the embodiment without departing from the spirit of the embodiment. Like or the same elements designated by like or the same numerals are used in drawings.

In the specification, expressions such as "A or B," "at least one of A or/and B," or "one or more of A or/and B" may include all possible combination of listed items. It will be understood that when an element (e.g., first element) is referred to as being "connected" or "coupled" to another element (e.g., second element), it can be directly connected or coupled to the other element (e.g., third element) or intervening elements may be present.

Figure 1:
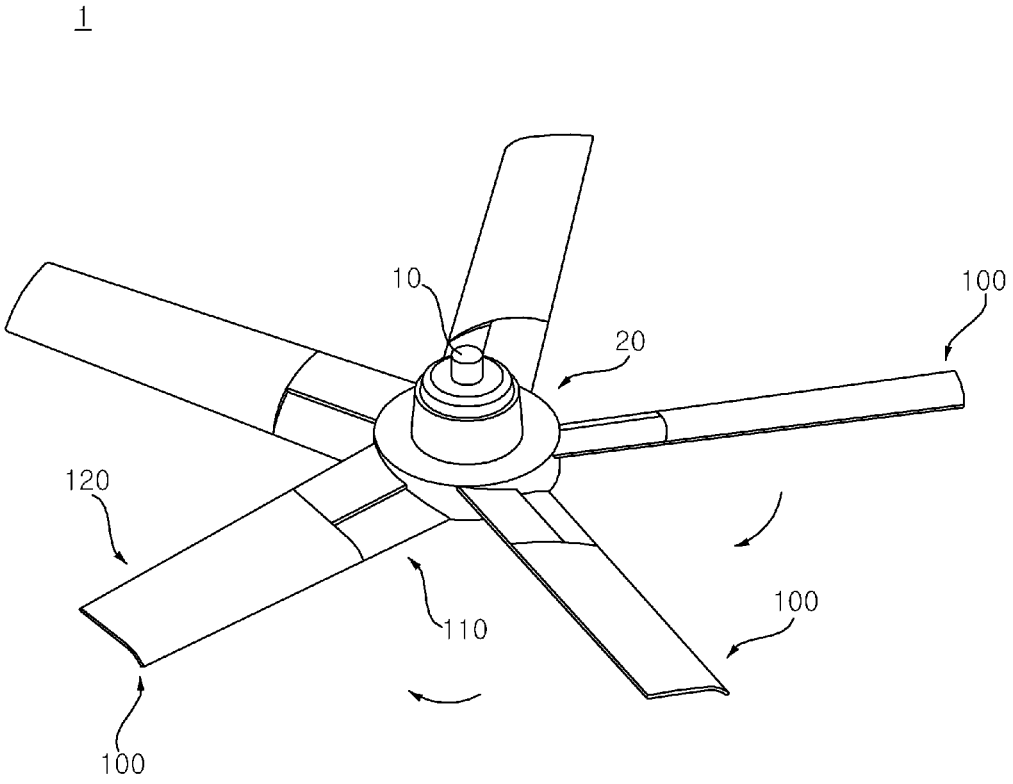
FIG. 1 is a perspective view showing a ceiling fan according to an embodiment of the present disclosure.

FIG. 1 is a perspective view showing a ceiling fan according to an embodiment of the present disclosure.

Referring to FIG. 1, a ceiling fan 1 according to an embodiment of the present disclosure includes a column 10 fixed to the ceiling, a hub case 20 which is disposed in the lower side of the column 10 and rotatable with respect to the column 10, a plurality of blades 100 which are disposed in the hub case 20 and disposed radially around the column 10, and a motor (not shown) which is disposed inside the hub case 20, fixed to the column 10 side, and provides rotational force to the hub case 20.

The column 10 may extend long in the up-down direction. The upper end of the column 10 is fixed to the ceiling, and the lower end of the column 10 is coupled to the hub case 20. The lower end of the column 10 is disposed rotatably relative to the hub case 20.

The hub case 20 can be rotated with respect to the column 10. The hub case 20 is formed in a cylindrical shape, and the blade 100 is coupled to the hub case 20.

The blade 100 is disposed to protrude outward in the radial direction from an outer circumferential surface of the hub case 20.

When viewed in the axial direction of the blade, the blade 100 is disposed radially around the column 10. In the present embodiment, five blades 100 are disposed. Unlike the present embodiment, the number of blades 100 may be changed.

Here, the axial direction of the blade may be parallel to the upward direction based on FIG. 1.

If classification is required, the five blades 100 may be classified into first to fifth blades. Hereinafter, the blade will be described in detail.

Figure 2:
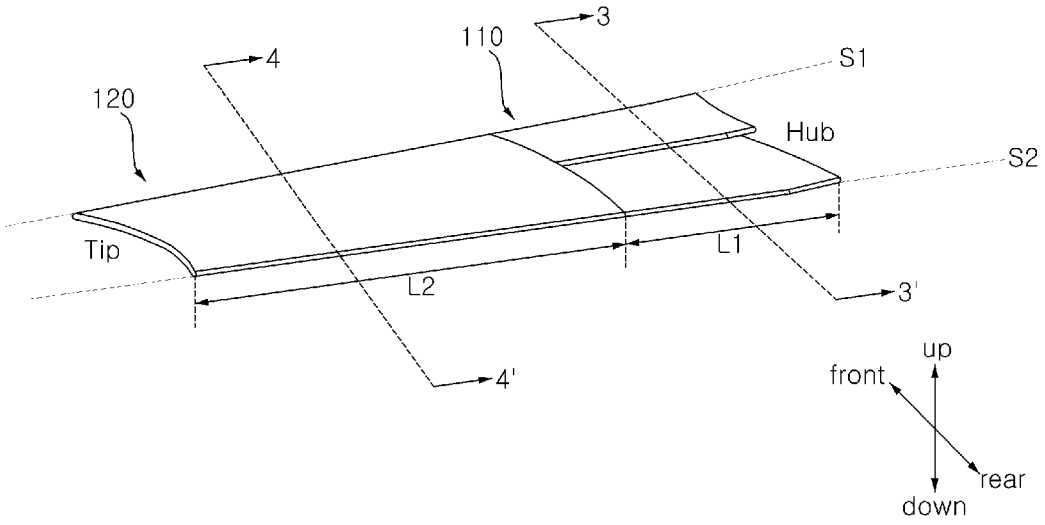
FIG. 2 is a perspective view showing a blade shown in FIG. 1.
Figure 3:
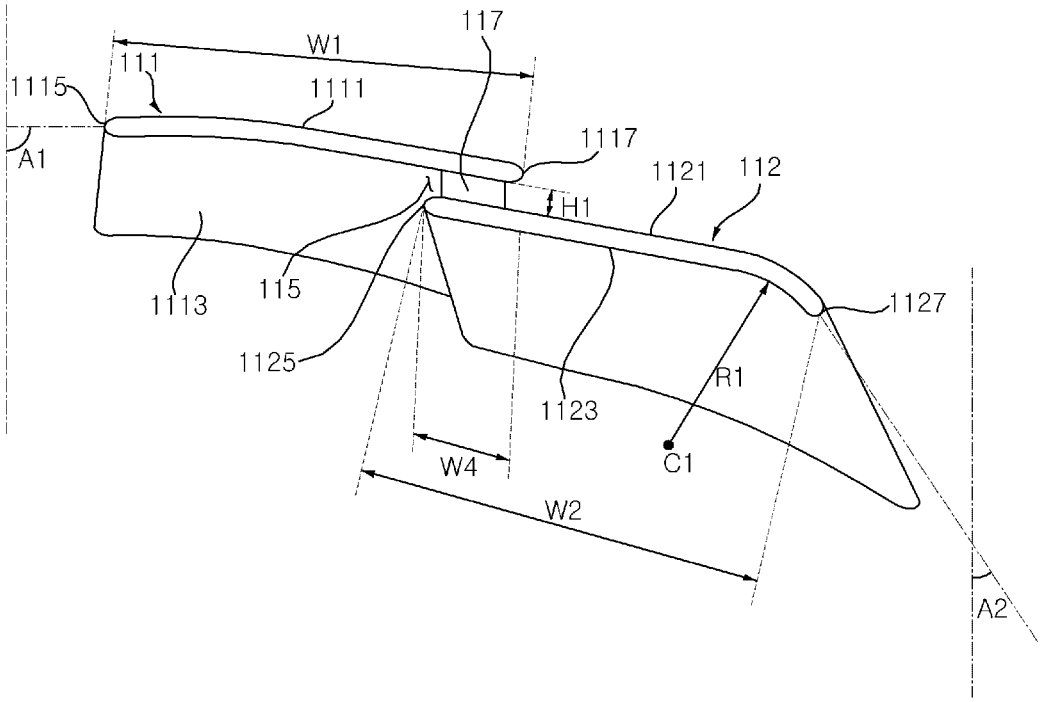
FIG. 3 is a cross-sectional view taken along line 3-3' of the blade shown in FIG. 2.

FIG. 2 is a perspective view showing the blade shown in FIG. 1, and FIG. 3 is a cross-sectional view taken along line 3-3' of the blade shown in FIG. 2.

Referring to FIGS. 1 to 3, the blade 100 includes an inner blade 110 that has one side 117 coupled to the hub case 20 and the other side 113 disposed to face outward in the radial direction, and an outer blade 120 connected to the outside of the inner blade 110.

The inner blade 110 is disposed relatively closer to the hub case 20 than the outer blade 120 in the blade. The inner blade 110 is located close to the hub case 20, so that sufficient lifting force is not generated and the air volume is not sufficient in an area of the inner blade 110. Accordingly, in the present disclosure, the inner blade 110 includes a first inner blade 111 and a second inner blade 112.

The first inner blade 111 and the second inner blade 112 may be spaced apart from each other. The first inner blade 111 and the second inner blade 112 may be vertically spaced apart from each other, and partially overlap each other in the left and right.

Specifically, the rear end of the first inner blade 111 and the front end of the second inner blade 112 overlap in the up-down direction, and the first inner blade 111 may be disposed higher than the second inner blade 112.

Here, a forward direction is a direction shown in FIGS. 2 and 3, and is a direction orthogonal to the up-down direction and the radial direction. The blade 100 rotates in a forward direction.

More specifically, the first inner blade 111 may include a first inner negative pressure surface 1111 defining a surface intersecting the axial direction, a first inner positive pressure surface 1113 which defines a surface intersecting the axial direction, and is located below the first inner negative pressure surface 1111, a first inner leading edge 1115 connecting the first inner negative pressure surface 1111 and the first inner positive pressure surface 1113, and a first inner trailing edge 1117 which connects the first inner negative pressure surface 1111 and the first inner positive pressure surface 1113 and is disposed in a rearward direction of the first inner leading edge 1115.

The second inner blade 112 may include a second inner negative pressure surface 1121 defining a surface intersecting the axial direction, a second inner positive pressure surface 1123 which defines a surface intersecting the axial direction and is located below the second inner negative pressure surface 1121, a second inner leading edge 1125 connecting the second inner negative pressure surface 1121 and the second inner positive pressure surface 1123, and a second inner trailing edge 1127 which connects the second inner negative pressure surface 1121 and the second inner positive pressure surface 1123 and is disposed in a rearward direction of the second inner leading edge 1125.

An area adjacent to the first trailing edge of the first inner blade 111 and an area adjacent to the second inner leading edge 1125 of the second inner blade 112 are disposed to overlap each other in the up-down direction.

In other words, the first inner blade 111 and the second inner blade 112 may have an overlapping area 115 in which a partial area overlaps in the axial direction of the hub case 20. By forming such an overlapping area 115, it is possible to prevent the first inner blade 111 and the second inner blade 112 from being distorted and to increase the air volume.

A width W4 of the overlapping area 115 may be smaller than a width W2 of the first inner blade 111 and the second inner blade 112.

If the width W4 of the overlapping area 115 is greater than the widths W2 of the first inner blade 111 and the second inner blade 112, the manufacturing cost of the blade and the weight of the blade increase too much.

Preferably, the width W4 of the overlapping area 115 may be 10% to 20% of the width W2 of the first inner blade 111 and the second inner blade 112.

The width W4 of the overlapping area 115 may be greater than a distance between the first inner blade 111 and the second inner blade 112 in the axial direction. Preferably, the width W4 of the overlapping area 115 may be 2 to 5 times the distance between the first inner blade 111 and the second inner blade 112 in the axial direction.

The width W4 of the overlapping area 115 may be greater than the thicknesses of the first inner blade 111 and the second inner blade 112. This is because when the width W4 of the overlapping area 115 is smaller than the thickness of the first inner blade 111 and the second inner blade 112, twisting of the blade is not prevented and the increasing effect of air volume is not great.

The height H1 (the distance between the first inner blade 111 and the second inner blade 112 in the axial direction) of the overlapping area 115 may be greater than the thickness of the first inner blade 111 and the thickness of the second inner blade 112. Preferably, the height H1 of the overlapping area 115 may be 1.5 to 3 times greater than the thickness of the first inner blade 111 and the thickness of the second inner blade 112.

If the height H1 of the overlapping area 115 is too large, there is a problem that the size of the fan increases because the thickness of the entire blade becomes too thick, and when the height H1 of the overlapping area 115 is smaller than the thickness of the first inner blade 111 and the thickness of the second inner blade 112, air flowing along the first inner positive pressure surface 1113 of the first inner blade 111 cannot sufficiently escape through the overlapping area 115, so that lifting force cannot be provided to the second inner blade 112.

The overlapping area 115 may extend in a radial direction orthogonal to the axial direction. The overlapping area 115 may be disposed in a center between the first inner leading edge 1115 of the first inner blade 111 and the second trailing edge 1127 of the second inner blade 112 when viewed in the axial direction.

In addition, the first inner blade 111 and the second inner blade 112 may be connected by a connection arm 117. A plurality of connection arms 117 are spaced apart from each other in the radial direction, so that air can flow between adjacent connection arms 117 as well. The connection arm 117 may be located within the overlapping area 115.

The first inner blade 111 and the second inner blade 112 may have the same length. This is because if the lengths of the first inner blade 111 and the second inner blade 112 are different, a connection point with the outer blade 120 is different, so that it is difficult to manufacture and it is difficult to control the air volume and efficiency.

The length L1 of the inner blade 110 may be smaller than the length L2 of the outer blade 120. Specifically, the length L1 of the inner blade 110 may be 30% to 40% of the length of the blade.

This is because that if the length L1 of the inner blade 110 is less than 30% of the blade length, the decrease in air volume in a center cannot be solved, and if the length L1 of the inner blade 110 is greater than 40% of the blade length, the efficiency of the fan is decreased.

Here, the length of the blade is a value obtained by adding the length L2 of the outer blade 120 to the length L1 of the inner blade 110.

The width W1 of the first inner blade 111 and the width W2 of the second inner blade 112 may be smaller than the width W3 of the outer blade 120. Preferably, the width W1 of the first inner blade 111 and the width W2 of the second inner blade 112 may be greater than half of the width W3 of the outer blade 120.

This is because that if the width W1 of the first inner blade 111 and the width W2 of the second inner blade 112 are smaller than half of the width W3 of the outer blade 120, a sufficient central air volume cannot be obtained, and the twisting of the blade cannot be prevented, and if the width W1 of the first inner blade 111 and the width W2 of the second inner blade 112 are greater than the width W3 of the outer blade 120, the weight of the blade becomes too heavy, and the efficiency of the fan decreases.

The vertical cross sections of the first inner blade 111 and the second inner blade 112 may be formed in an airfoil shape. Alternatively, the first inner blade 111 and the second inner blade 112 may have an inclination with respect to the axial direction.

Specifically, the first inner blade 111 and the second inner blade 112 may be disposed inclined downward from as it progresses from the front side to the rear side. That is, the first inner leading edge 1115 may be located above the first inner trailing edge 1117, and the second inner leading edge 1125 may be located above the second inner trailing edge 1127.

The inclination angle of the first inner blade 111 may be greater than or equal to the inclination angle of the second inner blade 112. The inclination angle of the first inner blade 111 means an angle between an arbitrary line connecting the first inner leading edge 1115 and the first inner trailing edge 1117 and the axial direction.

An entrance angle A1 of the first inner blade 111 may have an acute angle close to 90 degrees. Preferably, the entrance angle A1 of the first inner blade 111 may be 80 degrees to 87 degrees.

An exit angle A2 of the second inner blade 112 may have an acute angle close to 45 degrees. Preferably, the exit angle A2 of the second inner blade 112 may be 20 degrees to 45 degrees.

The first inner blade 111 may have a curvature. Specifically, the first inner blade 111 may have a curvature such that the center of the radius of curvature is located below the first inner blade 111. Accordingly, the first inner blade 111 may have an upwardly convex shape. The radius of curvature of the first inner blade 111 may increase as it progresses from the front side to the rear side.

The second inner blade 112 may have a curvature. Specifically, the second inner blade 112 may have a curvature such that the center C1 of the radius of curvature is located below the second inner blade 112. Accordingly, the second inner blade 112 may have an upwardly convex shape. The radius of curvature of the second inner blade 112 may decrease as it progresses from front side to rear side.

Obviously, the curvature may be formed only in a partial area of the first inner blade 111 and a partial area of the second inner blade 112.

That is, at least a part of the inner blade 110 may have a curvature such that the center of the radius of curvature is located below the inner blade 110.

Figure 4:
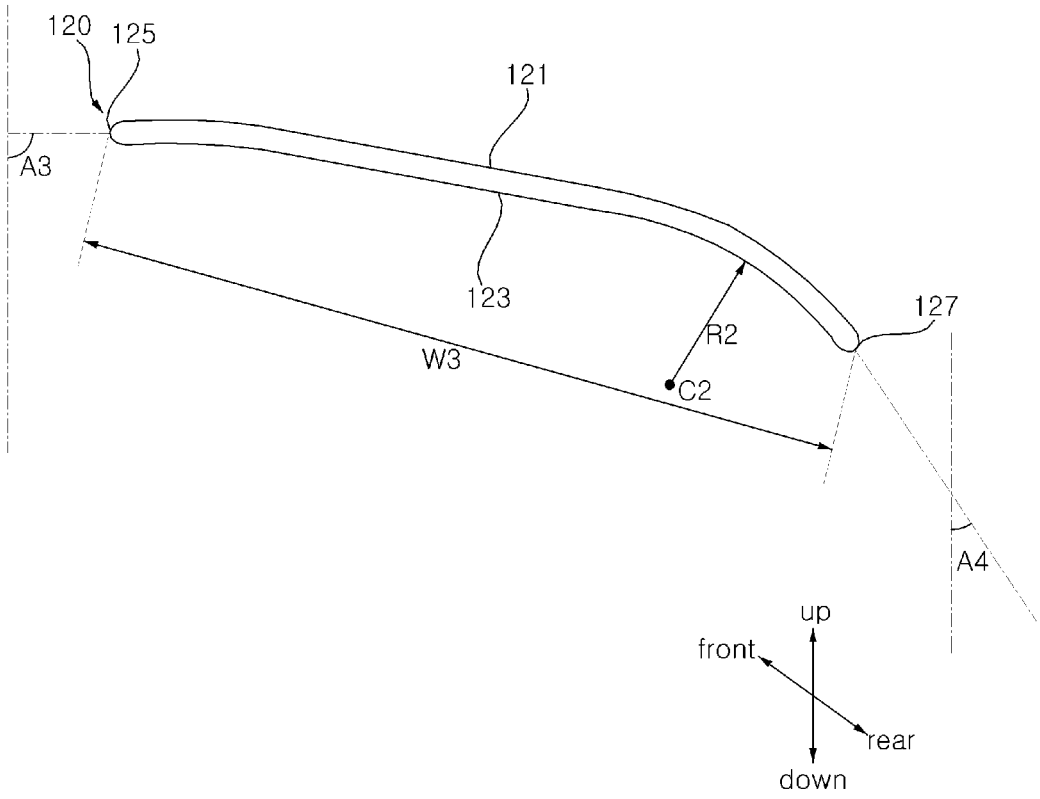
FIG. 4 is a cross-sectional view taken along line 4-4' of the blade shown in FIG. 2.

FIG. 4 is a cross-sectional view taken along the line 4-4' of the blade shown in FIG. 2. Hereinafter, the outer blade 120 will be described in detail.

In particular, referring to FIGS. 2 and 4, one side of the outer blade 120 is coupled to a part of the other end of the inner blade 110, and is disposed farther from the axis of the hub case 20 than the inner blade 110.

In the case of an area far from the hub, sufficient air volume is formed because it is located far from the axis and travels long during one rotation. In addition, since the blade located farther from the hub has greater air resistance and has greater twisting, one blade is formed to compensate for this.

Specifically, the inner side of the outer blade 120 in the radial direction is connected to the outer side of the inner blade 110 in the radial direction.

More specifically, the other end of the first inner blade 111 and one end of the outer blade 120 may be connected. An outer surface of the first inner blade 111 in the radial direction may be connected to an inner surface of the outer blade 120 in the radial direction.

The first inner blade 111 and the outer blade 120 may be overlapped in a radial direction orthogonal to the axial direction. That is, the first inner blade 111 and the outer blade 120 may be formed as one body.

When the first inner blade 111 and the outer blade 120 are formed as one body, the first inner blade 111 and the outer blade 120 are manufactured in one process, and then the second inner blade 112 is combined, thereby easily manufacturing the blade.

The outer blade 120 may include an outer negative pressure surface 121 defining a surface intersecting the axial direction, an outer positive pressure surface 123 that defines a surface intersecting the axial direction, and is located below the outer negative pressure surface 121, an outer leading edge 125 connecting the outer negative pressure surface 121 and the outer positive pressure surface 123, and an outer trailing edge 127 that connects the outer negative pressure surface 121 and the outer positive pressure surface 123 and is disposed rearward than the outer leading edge 125.

The first inner negative pressure surface 1111 and the outer negative pressure surface 121 may be connected as one surface, and the first inner positive pressure surface 1113 and the outer positive pressure surface 123 may be connected as one surface. When the first inner negative pressure surface 1111 and the outer negative pressure surface 121 are connected as one surface, and the first inner positive pressure surface 1113 and the outer positive pressure surface 123 are connected as one surface, they operate like a single blade, and has the advantage of being easy to analyze and easy to manufacture.

A part of the vertical cross section of the outer blade 120 and the vertical cross section of the first inner blade 111 may overlap in the radial direction. A part of the shape of the vertical cross section of the outer blade 120 may be the same as the shape of the vertical cross section of the first inner blade 111.

The outer leading edge 125 of the outer blade 120 and the first inner leading edge 1115 of the first inner blade 111 may be located on a first reference line. The first reference line is a straight line that extends substantially in the radial direction.

The outer trailing edge 127 of the outer blade 120 and the second inner trailing edge 1127 of the second inner blade 112 may be located on a second reference line. The second reference line is a straight line that extends substantially in the radial direction.

The first reference line and the second reference line may be parallel. Alternatively, a distance between the first reference line and the second reference line may decrease as it goes farther away from the hub case 20.

A partial area of the outer blade 120 may be located in a lower position than the first inner blade 111, and another partial area excluding the partial area of the outer blade 120 may be located in the same height as the first inner blade 111.

Specifically, the area of the outer blade 120 adjacent to the outer trailing edge 127 may be located in a position lower than the first inner blade 111, and the area of the outer blade 120 adjacent to the outer leading edge 125 may be located at the same height as the first inner blade 111.

The width W3 of the outer blade 120 may be smaller than or equal to a value obtained by subtracting the width W4 of the overlapping area 115 from the sum of the width W1 of the first inner blade 111 and the width W2 of the second inner blade 112.

This is to maintain the rigidity of the blade and reduce the vibration of the blade, because the air volume increases in the area that is further away from the hub case 20, and even if the width of the wing is reduced, the air volume is not severely reduced, A vertical cross section of the outer blade 120 may be formed in an airfoil shape. Alternatively, the outer blade 120 may have an inclination with respect to the axial direction.

The outer blade 120 may be disposed inclined downward from as it progresses from the front side to the rear side. That is, the outer leading edge 125 may be located higher than the outer trailing edge 127.

The inclination angle of the outer blade 120 may be the same as the inclination angle of the inner blade 110. The inclination angle of the outer blade 120 means an angle formed by an arbitrary line connecting the outer leading edge 125 and the outer trailing edge 127 with respect to the axial direction, and the inclination angle of the inner blade 110 means an angle formed by an arbitrary line connecting the first inner leading edge 1115 and the second inner trailing edge 1127 with respect to the axial direction.

The entrance angle A3 of the outer blade 120 may have an acute angle close to 90 degrees. Preferably, the entrance angle A3 of the outer blade 120 may be 80 degrees to 87 degrees. More preferably, the entrance angle A3 of the outer blade 120 may be the same as the entrance angle A1 of the first inner blade 111.

The exit angle A4 of the outer blade 120 may have an acute angle close to 45 degrees. Preferably, the exit angle A4 of the outer blade 120 may be 20 degrees to 45 degrees. More preferably, the exit angle A4 of the outer blade 120 may be the same as the exit angle A2 of the second inner blade 112.

The outer blade 120 may have a curvature. Specifically, the first outer blade 120 may have a curvature such that the center C2 of the radius of curvature is located lower than the first outer blade 120. Thus, the outer blade 120 may have an upwardly convex shape. The radius of curvature of the outer blade 120 may decrease as it progresses from front side to rear side.

Obviously, curvature may be formed only in a partial area of the outer blade 120. That is, at least a part of the outer blade 120 may have a curvature such that the center of the radius of curvature is located below the outer blade 120.

In particular, the radius of curvature R2 of the area adjacent to the outer trailing edge 127 in the outer blade 120 may be smaller than the radius of curvature R1 of the area adjacent to the second inner trailing edge 1127 in the second inner blade 112.

Figure 5:
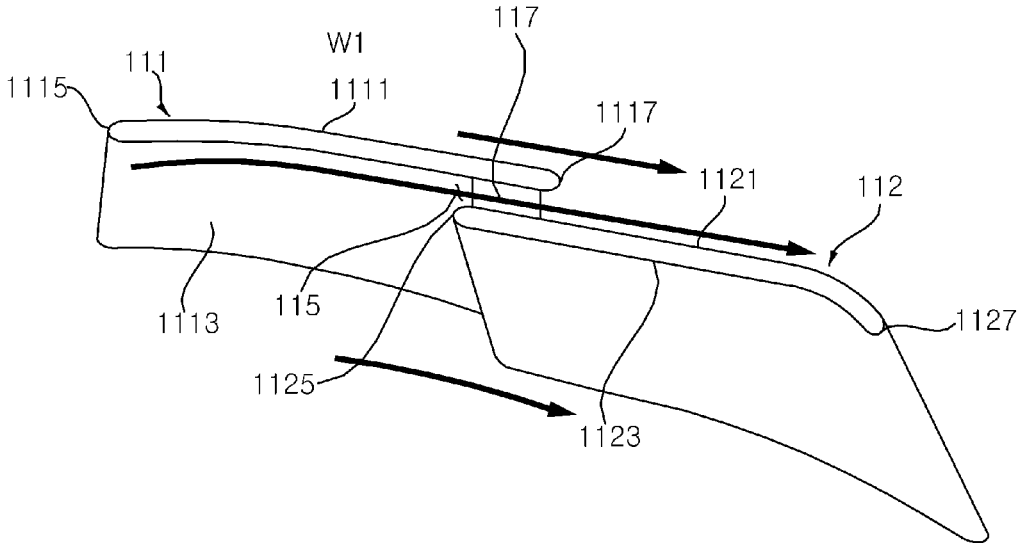
FIG. 5 is an exemplary diagram illustrating air flow in FIG. 3.

Referring to FIG. 5, the air flow during rotation of the ceiling fan will be described.

When the hub case 20 rotates, a plurality of blades 100 also rotate together. At this time, the air pressurized by the first inner blade 111 based on one blade 100 may flow to the second inner blade 112.

Specifically, the air pressurized on the first inner positive pressure surface 1113 of the first inner blade 111 may flow to the second inner negative pressure surface 1121 of the second inner blade 112 through the overlapping area 115, flow downward along the second inner negative pressure surface 1121 of the second inner blade 112, and then may be separated from the second inner trailing edge 1127 of the second inner blade 112 and discharged downward.

In addition, the air pressurized by the second inner positive pressure surface 1123 of the second inner blade 112 may be separated from the second inner trailing edge 1127 of the second inner blade 112 and discharged downward. As described above, since the blade 100 according to the present embodiment constitutes a tandem blade, it can form a larger lifting force than a blade having one positive pressure surface and one negative pressure surface. Through this, the air volume can be increased at the same output, and twisting of an area far from the hub case 20 can be effectively prevented without a separate tip.

Figure 6:
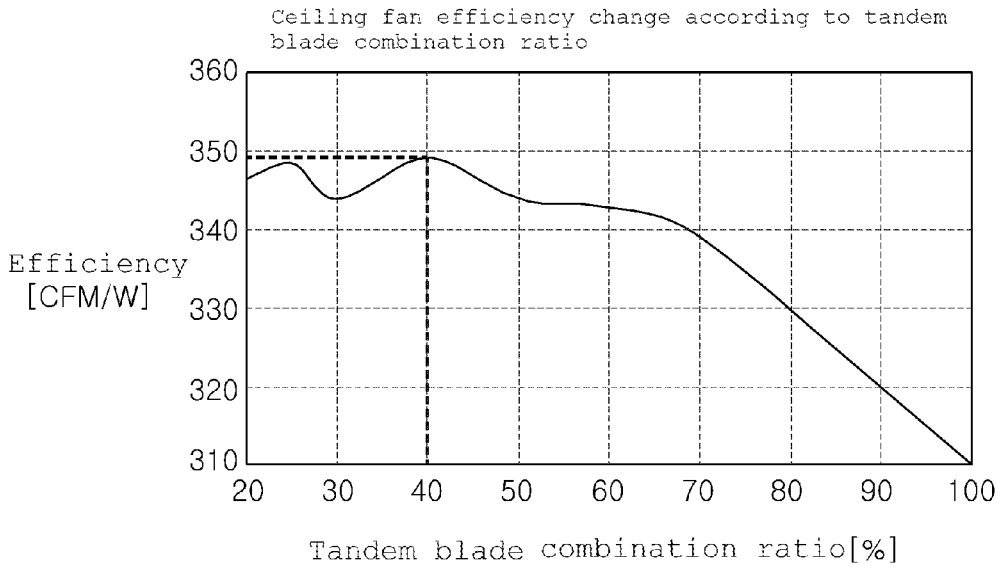
FIG. 6 is a diagram showing the efficiency of a fan versus a length of tandem blade.

FIG. 6 is a diagram showing the efficiency of the fan versus the length of the tandem blade.

Referring to FIG. 6, when the length L1 of the inner blade 110 is less than 40% of the blade length, the efficiency of the fan is reduced, and when the length L1 of the inner blade 110 is larger than 40% of the blade length, the efficiency of the fan is reduced.

Accordingly, the length L1 of the inner blade 110 is preferably approximately 38% to 42% of the length of the blade.

While the present disclosure has been particularly shown and described with reference to exemplary embodiments thereof, it will be understood by those of ordinary skill in the art that various changes in form and detail may be made herein without departing from the spirit and scope of the present disclosure as defined by the following claims and such modifications and variations should not be understood individually from the technical idea or aspect of the present disclosure.

What is claimed is:

1. A ceiling fan comprising:

a column;

a hub case which is coupled to the column and rotatable with respect to the column; and a plurality of blades disposed in the hub case, wherein each of the blades comprises:

an inner blade having one side coupled to the hub case; and an outer blade having one side that is coupled to a part of another end of the inner blade and disposed farther from an axis of the hub case than the inner blade, wherein the inner blade comprises:

a first inner blade having one side coupled to the hub case; and a second inner blade spaced apart from the first inner blade and having one side coupled to the hub case.

2. The ceiling fan of claim 1, wherein the first inner blade is disposed in a position higher than the second inner blade.

3. The ceiling fan of claim 1, wherein the first inner blade and the second inner blade have an overlapping area in which a partial area overlaps in an axial direction of the hub case.

4. The ceiling fan of claim 3, wherein a width of the overlapping area is smaller than a width of the first inner blade and the second inner blade.

5. The ceiling fan of claim 3, wherein a width of the overlapping area is greater than a separation distance between the first inner blade and the second inner blade in the axial direction.

6. The ceiling fan of claim 3, wherein a width of the overlapping area is greater than a thickness of the first inner blade and the second inner blade.

7. The ceiling fan of claim 1, wherein the inner blade further comprises a connection arm connecting the first inner blade and the second inner blade.

8. The ceiling fan of claim 7, wherein the first inner blade and the second inner blade have an overlapping area in which a partial area overlaps in an axial direction of the hub case, and wherein the connection arm is located in the overlapping area.

9. The ceiling fan of claim 1, wherein a length of the inner blade is smaller than a length of the outer blade.

10. The ceiling fan of claim 1, wherein a length of the inner blade has a length of 30% to 40% of the length of the blade.

11. The ceiling fan of claim 1, wherein a width of the first inner blade and a width of the second inner blade are smaller than a width of the outer blade.

12. The ceiling fan of claim 11, wherein the width of the first inner blade and the width of the second inner blade are greater than half of the width of the outer blade.

13. The ceiling fan of claim 1, wherein the other end of the first inner blade and one end of the outer blade are connected.

14. The ceiling fan of claim 13, wherein the first inner blade and the outer blade are overlapped in a radial direction orthogonal to the axial direction.

15. The ceiling fan of claim 13, wherein the first inner blade comprises:

a first inner negative pressure surface defining a surface intersecting the axial direction; and a first inner positive pressure surface which defines a surface intersecting the axial direction and is located below the first inner negative pressure surface, wherein the outer blade comprises:

an outer negative pressure surface defining a surface intersecting the axial direction; and an outer positive pressure surface which defines a surface intersecting the axial direction and is located below the outer negative pressure surface, wherein the first inner negative pressure surface and the outer negative pressure surface are connected as one surface, and the first inner positive pressure surface and the outer positive pressure surface are connected as one surface.

16. The ceiling fan of claim 13, wherein the first inner blade and the outer blade are formed as one body.

17. The ceiling fan of claim 1, wherein a partial area of the outer blade is located in a position lower than the first inner blade, and another partial area excluding the partial area of the outer blade is located in the same height as the first inner blade.

18. The ceiling fan of claim 1, wherein at least a part of the inner blade has a curvature in which a center of a radius of curvature is located below the inner blade.

19. The ceiling fan of claim 1, wherein at least a part of the outer blade has a curvature in which a center of a radius of curvature is located below the outer blade.

* * * * *